US008480872B2

(12) United States Patent
Fan et al.

(10) Patent No.: US 8,480,872 B2
(45) Date of Patent: Jul. 9, 2013

(54) ELECTROCOATING INTERNAL SURFACES OF A METALLIC SUBSTRATE USING A WIRELESS ELECTRODE

(75) Inventors: Hua-Tzu Fan, Troy, MI (US); Yar-Ming Wang, Rochester Hills, MI (US); Hong-Hsiang Kuo, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 328 days.

(21) Appl. No.: 12/987,457

(22) Filed: Jan. 10, 2011

(65) Prior Publication Data

US 2012/0175256 A1 Jul. 12, 2012

(51) Int. Cl.
*C25D 13/14* (2006.01)
*C25D 17/12* (2006.01)

(52) U.S. Cl.
USPC ..... 204/474; 204/479; 204/625

(58) Field of Classification Search
USPC ..... 204/474, 479, 625
See application file for complete search history.

(56) References Cited

U.S. PATENT DOCUMENTS 3,476,667 A 11/1969 Gilchrist

*Primary Examiner* — Kishor Mayekar
(74) *Attorney, Agent, or Firm* — Quinn Law Group, PLLC

(57) ABSTRACT

A system for electro-coating a metallic substrate includes a DC power supply, a primary electrode, and a wireless auxiliary electrode. The primary electrode transmits electrical current through electrolyte fluid when energized by the power supply. The auxiliary electrode is within the drain hole, and receives the current from the fluid at one end. The auxiliary electrode boosts the calibrated voltage at the opposite end near the drain hole. In a method for depositing thin film material onto the internal surfaces, the wireless auxiliary electrode is positioned in the drain hole, and the calibrated voltage is applied from the DC power supply to the primary electrode. Electrical current transmitted through the fluid is received at the first end of the auxiliary electrode. The calibrated voltage is boosted in proximity to the drain hole at the second end of the same auxiliary electrode. A wireless auxiliary electrode assembly is also provided.

16 Claims, 2 Drawing Sheets

ELECTROCOATING INTERNAL SURFACES OF A METALLIC SUBSTRATE USING A WIRELESS ELECTRODE

TECHNICAL FIELD

The present invention relates to a system and method for electrocoating internal surfaces of a metallic substrate using a wireless electrode.

BACKGROUND

Electrocoating or E-coating is a metal finishing process in which a thin film polymer or other suitable material is deposited onto a properly prepared surface of a metallic substrate. During a typical automotive E-coating process, a metal vehicle body or panel passes through a tank containing an electrolyte fluid, e.g., a mixture of resin binder and a paste containing paint of a desired pigment. Primary electrodes in the form of steel plates line the walls of the tank. Electrical current is applied to the primary electrodes and flows through the electrolyte fluid to the substrate and to ground. The electrical current is supplied via an overhead conveyor as the substrate moves through the electrolyte fluid. E-coating thus uses strategically-positioned primary electrodes to precisely control the deposition of paint molecules onto the various surfaces of the metallic substrate. The paint molecules adhere to the surface, and after curing provide a finished appearance.

SUMMARY

A system and method are disclosed herein for augmenting the function of primary electrodes in an electrocoating (E-coating) process using strategically-positioned wireless auxiliary electrodes or anodes. The wireless auxiliary electrodes are used to help to improve throwing power, i.e., the ability to uniformly deposit a thin film material onto a metallic substrate having an irregular shape. For example, certain automotive panel assemblies such as B-pillars or rocker panels define various internal surfaces, some of which may be difficult to E-coat using the primary electrodes in an E-coating tank. The present wireless auxiliary electrodes are therefore intended to improve the material deposition rate at such internal surfaces, thereby optimizing uniformity of coverage.

In particular, a system for E-coating a metallic substrate includes a main DC power supply having a calibrated voltage, a hard-wired primary electrode, and a wireless auxiliary electrode. The primary electrode transmits an electrical current through a volume of electrolyte fluid when energized by the DC power supply. The wireless auxiliary electrode is positionable within a drain hole of the substrate, and receives the electrical current from the electrolyte fluid at one end of the auxiliary electrode. The wireless electrode boosts the calibrated voltage at the opposite end, which is in proximity to the drain hole. The internal surface is in fluid communication with the electrolyte fluid only through the drain hole. That is, any surfaces of the substrate which may be wetted by the electrolyte fluid without first passing through a drain hole are external surfaces, and are coated using the main electrodes.

A method is also provided for depositing a thin film material onto internal surfaces of the metallic substrate. A wireless auxiliary electrode is positioned in a drain hole defined by the substrate, and a calibrated voltage is applied from a DC power supply to a primary electrode. This generates an electrical current. The method further includes transmitting the electrical current through an electrolyte fluid toward the substrate, receiving the electrical current at the first end of the wireless auxiliary electrode, and boosting the calibrated voltage in proximity to the drain hole at a second end of the same electrode.

A wireless auxiliary electrode assembly is also provided herein for E-coating a metallic substrate defining a pair of internal surfaces. The assembly includes a stainless steel wire having a first and a second end. Extensions at the first end receive an electrical current transmitted through the electrolyte fluid by a primary electrode when the primary electrode is energized by a DC power supply. The second end is positioned between the pair of internal surfaces. The assembly further includes a porous stopper which positions the wireless electrode within the drain hole, and which allows the electrolyte fluid to flow to and from the internal surfaces. A voltage booster boosts a calibrated voltage from the main DC power supply at the second end.

The above features and advantages and other features and advantages of the present invention are readily apparent from the following detailed description of the best modes for carrying out the invention when taken in connection with the accompanying drawings.

DESCRIPTION

Figure 1:
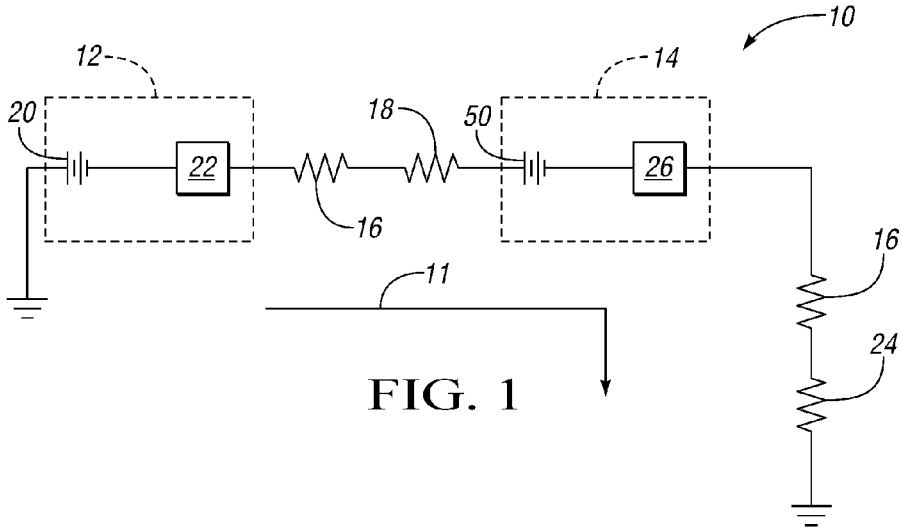
FIG. 1 is a schematic illustration of a system for electrocoating (E-coating) an internal surface of a metallic substrate.

Referring to the drawings, wherein like reference numbers correspond to like or similar components throughout the several figures, a system 10 is shown in schematic form for use in an electrocoating (E-coating) process. A main or primary electrode 12 is used in conjunction with a wireless auxiliary electrode 14. The system 10 uses any number of the wireless auxiliary electrodes 14 to improve an E-coating deposition rate at strategically selected internal surfaces of a metallic substrate, e.g., the internal surfaces 34 of the metallic substrate 30 shown in FIG. 2 and described in detail below.

Figure 2:
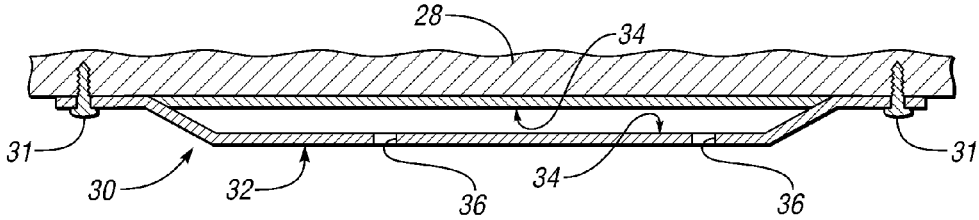
FIG. 2 is a cross-sectional side view of a vehicle panel assembly that may be used as the metallic substrate according to one possible embodiment.

During a typical E-coating process, a thin film material such as paint is deposited onto a prepared surface of a grounded object, for instance the metallic substrate 30 of FIG. 2, via a path of least electrical resistance. External surfaces of the grounded object are coated first, with the material subsequently flowing toward any internal surfaces as permitted by the flow configuration of the grounded object. The internal surfaces, e.g., surfaces within the various cavities, channels, or crevices defined by the structure of the grounded object, are prone to reduced coverage. The coating rate on these internal surfaces determines the cycle time and corrosion performance of the coated substrate. The present invention is therefore directed toward optimizing coverage of these internal surfaces.

A main DC power supply 20 is used in conjunction with a main circuit 22 of the primary electrode(s) 12 in order to coat the primary or external surfaces of a targeted metallic substrate 30. Referring briefly to FIG. 2, one possible embodiment of such a metallic substrate 30 is a vehicle panel assembly, e.g., a B-pillar, a rocker panel, or other suitable panel assembly. Such a panel assembly may be mounted via fasteners 31 to an adjacent structure 28, e.g., an adjacent vehicle body, support structure, or suitable portion thereof.

The metallic substrate 30 includes an exterior surface 32, which is coated using the primary electrode 12 noted above. Multiple primary electrodes 12 may be configured as steel plates which line a tank (not shown) filled with an electrolyte fluid 40 (see FIG. 3), as is well understood in the art. The metallic substrate 30 defines various internal surfaces 34, i.e., surfaces which may be reached or wetted by the electrolyte fluid 40 only through one or more drain holes 36. Such drain holes 36 may be formed in or otherwise defined by the metallic substrate 30. The positioning, size, and number of drain holes 36 may vary with the particular design and internal geometry of the metallic substrate 30. The auxiliary electrodes 14 of FIG. 1 may be used to boost throwing power in close proximity to such drain holes 36, and to thereby optimize the uniformity of coverage of the internal surfaces 34 near such drain holes.

Figure 3:
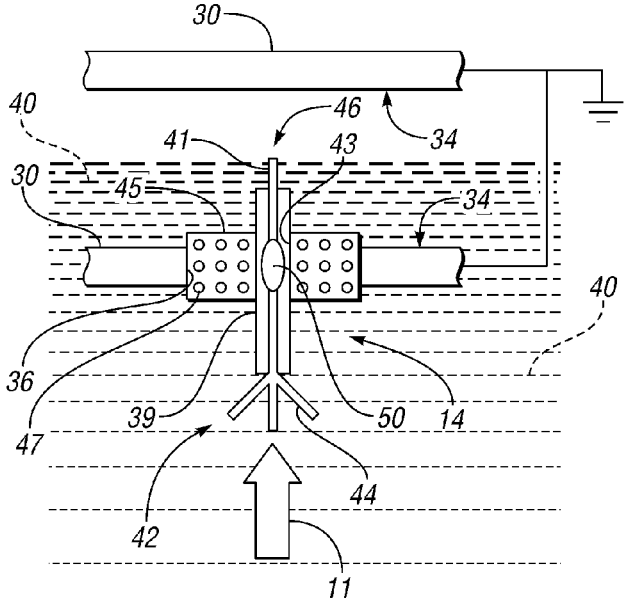
FIG. 3 is a schematic illustration of a wireless auxiliary electrode assembly for use with the system shown in FIG. 1.

Referring again to FIG. 1, the electrolyte fluid 40 of FIG. 3 has an equivalent resistance 16, and the paint or other E-coating material has an equivalent resistance 18. An electrical flow path is represented as an electrical current (arrow 11) which flows from the main DC power supply 20, e.g., an approximately 250 VDC battery in one possible embodiment. The DC power supply 20 is at a calibrated potential or voltage, which drives the electrical current (arrow 11) so that it flows through the electrolyte fluid and paint (equivalent resistances 16 and 18, respectively) to the auxiliary electrode 14.

From the auxiliary electrode 14, a voltage booster 50 boosts the calibrated voltage to an electrode circuit 26 of the auxiliary electrode 14, with the electrical current (arrow 11) ultimately flowing through the electrolyte fluid 40 (i.e., equivalent resistance 16) to the grounded object, i.e., the metallic substrate 30 shown in FIGS. 2 and 3. The grounded object is represented in FIG. 1 by an equivalent resistance 24, which changes as the thin film material accumulates on the surface of the grounded object. Thus, the equivalent resistance 24 is a measure of the resistance of both the grounded object and the E-coating material.

Referring to FIG. 3, the auxiliary electrode 14 of FIG. 1 may be positioned within a given drain hole 36 of the metallic substrate 30 (also see FIG. 2). The auxiliary electrode 14 may include a wire 41, e.g., stainless steel, that is encapsulated within an insulating enclosure 39, i.e., a chemically inert dielectric material such as polytetrafluoroethylene (PTFE) or other fluorocarbon material, polypropylene, rubber, ceramic, glass, porcelain, etc. The insulating enclosure 39 renders any insulated portions of the auxiliary electrode 14 electrically insulated and protected from contact with the electrolyte fluid 40.

The auxiliary electrode 14 includes a leading end or tip 46 and a tail end 42. The tip 46 is positioned within the electrolyte fluid 40 between the internal surfaces 34. The tail end 42 has at least one conducting extension 44. Each extension 44 acts as a lightning rod to draw the electrical current (arrow 11) flowing from the main DC power supply 20 of FIG. 1 as the electrical current passes, wirelessly, through the electrolyte fluid 40. The number of extensions 44 may vary with the design. In general, the greater the surface area used in the various extensions 44 of the tail end 42, the more electrical current (arrow 11) that can be drawn by the auxiliary electrode 14. More current draw equates to increased coating capacity. While three extensions 44 are shown in the embodiment of FIG. 3, only one extension may be used in one embodiment, while two extensions can be used in another. More than three extensions 44 can also be used depending on the design, with a cost/benefit tradeoff for numbers exceeding three.

In the embodiment shown in FIG. 2, one wireless auxiliary electrode 14 can be affixed within a given drain hole 36, for example using a porous stopper 45. The porous stopper 45 may be a cylindrical device having a center opening 43, which may be constructed of ceramic in one possible embodiment, although other suitable materials may also be used. In one embodiment, the porous stopper 45 can be press-fitted into the drain hole 36, with the auxiliary electrode 14 likewise press-fitted into the center opening 43. The fit should be snug enough to prevent inadvertent dislodgement of the auxiliary electrode 14 as the metallic substrate 30 moves through the electrolyte fluid 40, but yet loose enough to facilitate insertion and removal. The internal porosity of the porous stopper 45, i.e., the various fluid channels 47 or conduits defined by the material of the porous stopper, allow the electrolyte fluid 40 to freely flow into and out of any otherwise air-trapped areas to reach the internal surfaces 34.

Still referring to FIG. 3, each wireless auxiliary electrode 14 includes the voltage booster 50 noted briefly above. The voltage booster 50, as the name implies, boosts the calibrated voltage from the main DC power supply 20, doing so in close proximity to the drain holes 36 within which the auxiliary electrode 14 is affixed. To improve coverage of the internal surfaces 34, the voltage booster 50 may provide a boost of approximately 20% to approximately 50% of the calibrated voltage delivered by the main DC power supply 20. For example, when the main DC power supply is a 250 VDC device as noted above, the voltage booster 50 may provide a boost of approximately 50 to 125 VDC. In a simplified embodiment, the voltage booster 50 may be configured as a small DC battery, e.g., a miniature mercury battery having a fixed calibrated voltage. Such a battery may be used to deliver the calibrated voltage as needed in a cost effective manner.

Figure 4:
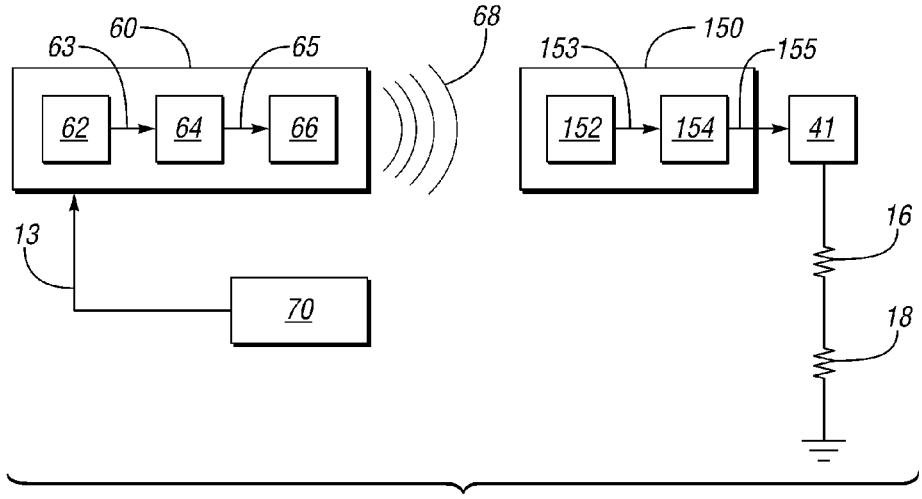
FIG. 4 is a schematic illustration of a wireless transmitting unit and a wireless receiving unit according to one embodiment.

Referring to FIG. 4, another voltage booster 150 may be configured as wireless induction device in lieu of the simple battery embodiment noted above. This embodiment may provide cost effective voltage control features as described below. A transmitting (TX) unit 60 may include an alternate current (AC) power supply 62, a TX circuit 64, and a TX antenna 66. The AC power supply 62 can supply sufficient AC electrical current (arrow 63) to the TX circuit 64, for example in response to a control signal (arrow 13) from a controller 70. The TX circuit 64 may be configured as an AC current modulator, and therefore can automatically regulate and modulate the AC electrical current (arrow 63). A regulated AC electrical current (arrow 65) is delivered to the TX antenna 66 with predetermined characteristics to thereby energize the TX antenna.

In this embodiment, an electromagnetic wave 68 propagates through the electrolyte fluid 40. The voltage booster 150 includes an RX antenna 152, e.g., an induction coil, and an RX circuit 154. The RX antenna 152 receives and converts the electromagnetic wave 68 into an AC electrical signal (arrow 153) that corresponds to the amplitude and frequency of the electromagnetic wave. The RX circuit 154 may be configured as an AC-to-DC power converter, and thus converts the AC electrical signal (arrow 153) from the RX antenna 152 into a suitable DC voltage (arrow 155). The DC voltage (arrow 155) is then applied to the wire 41 of FIG. 3, thereby providing a voltage boost or electromotive force (EMF) at the tip 46 shown in the same Figure. The EMF throws or drives the thin film material toward the targeted internal surface(s) 34 (see FIGS. 2 and 3).

The optional controller 70 may include a host machine and/or multiple digital computers or data processing devices each having one or more microprocessors or central processing units. The controller 70 may be configured to control the output of the AC power supply 62. As the E-coating process progresses, the thin film material accumulates on the tail end 42 of FIG. 3. This ultimately increases the resistance. As a result, decreasing voltage levels can be reached at the tip 46 of the auxiliary electrode after the same voltage boost. The controller 70 in this particular embodiment could be configured to increase the AC electrical current (arrow 63) as a function of the dwell time of the metallic substrate 30 within the electrolyte fluid 40, and/or using other control parameters.

The controller 70 may include sufficient read only memory (ROM), random access memory (RAM), electrically-erasable programmable read only memory (EEPROM), a high-speed clock, analog-to-digital (A/D) circuitry, digital-to-analog (D/A) circuitry, and any required input/output (I/O) circuitry and devices, as well as signal conditioning and buffering electronics. While shown as a single device in FIG. 1 for simplicity and clarity, the various elements of the controller 70 may be distributed over as many different hardware and software components as are required.

Figure 5:
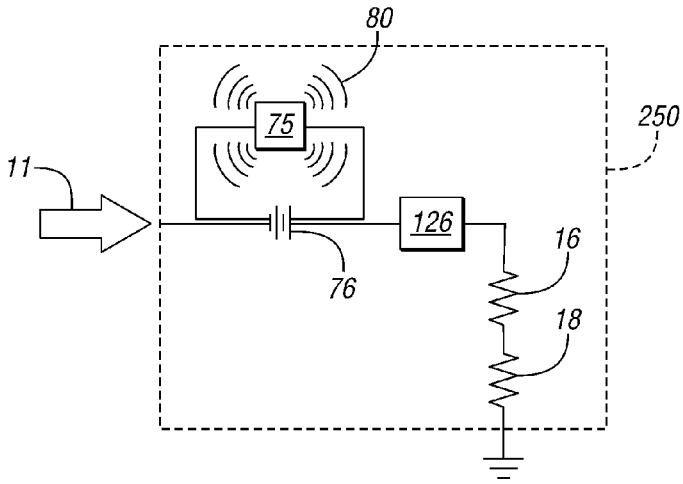
FIG. 5 is a schematic illustration of an energy harvesting device usable with the wireless auxiliary electrode according to another embodiment.

Referring to FIG. 5, in another embodiment a voltage booster 250 may include an energy harvesting device 75 and a rechargeable energy storage device 76, which are in series with an electrode circuit 126. This variant of the voltage booster 50 of FIG. 3 may be configured as a piezoelectric device, e.g., crystals or fibers that can be electrically stimulated using vibration energy 80. When an automotive panel or body is E-coated, the entire panel or body is first attached to an overhead conveyor and moved through the factory before reaching the electrolyte fluid 40. The motion of such a conveyor creates substantial vibration energy, which may be used as the vibration energy 80. The harvested energy may be stored in the energy storage device 76 for later use in powering the auxiliary electrode 14 of FIG. 3. In this manner, energy storage device 76 can be pre-charged long before the boost is actually required at the point of use.

Figure 6:
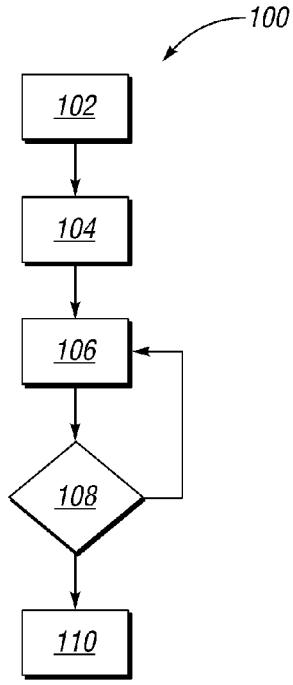
FIG. 6 is a flow chart describing a method for E-coating an internal surface of a metallic substrate using the system shown in FIG. 1.

Referring to FIG. 6, a method 100 is shown for conducting an E-coating process using the system 10 of FIG. 1. At step 102, a sufficient number of wireless auxiliary electrodes 14 are positioned within the various drain holes 36 shown in FIG. 2. Step 102 may entail press-fitting or otherwise positioning a porous stopper 45 (see FIG. 3) in each drain hole 36. Once positioned, the method 100 proceeds to step 104.

At step 104, the metallic substrate 30 of FIGS. 2 and 3 is positioned within the electrolyte fluid 40, e.g., by controlling a conveyor system (not shown). Once positioned in the electrolyte fluid 40, the method 100 proceeds to step 106.

At step 106, the primary electrode 12 of FIG. 1 is energized via the main DC power supply 20 shown in that Figure. The electrical current (arrow 11) flows through the electrolyte fluid 40 to the tail end 42. As noted above, the tail end 42 acts as a lightning rod to draw the electrical current (arrow 11) into the wireless auxiliary electrode 14. The voltage booster 50 is activated to boost the throwing power in proximity to the drain hole 36 in which the auxiliary electrode 14 is positioned.

In one embodiment, the controller 70 of FIG. 4 energizes the TX circuit 64 using the power supply 62 via the control signals (arrow 13). In response, the TX antenna 66 transmits the electromagnetic wave 68 through the electrolyte fluid 40. Step 106 may include varying the AC electrical current (arrow 63) of FIG. 4 to maintain the EMF within a calibrated range throughout the E-coating process. In another embodiment, the voltage booster 50 is simply activated such that the voltage booster delivers its stored charge via the tip 46.

At step 108, a calibrated interval of immersion in the electrolyte fluid 40 can be used to verify a required thickness of the deposited layers, although other direct or indirect verification means may also be used. Steps 108 and 106 continue in a loop until the thickness of the deposited layers is sufficient. The method 100 then proceeds to step 110.

At step 110, the metallic substrate 30 of FIGS. 2 and 3 is removed from the electrolyte fluid 40, and the auxiliary electrodes 14 are removed from the drain holes 36 for cleaning of any paint that might have accumulated on the exposed surfaces of the wire 41 during the preceding process.

While the best modes for carrying out the invention have been described in detail, those familiar with the art to which this invention relates will recognize various alternative designs and embodiments for practicing the invention within the scope of the appended claims.

The invention claimed is:

1. A system for electrocoating a metallic substrate, wherein the metallic substrate defines a drain hole and an internal surface, the system comprising:

a main DC power supply having a calibrated voltage;

a primary electrode configured to transmit an electrical current through an electrolyte fluid when energized by the DC power supply; and an auxiliary electrode positionable within the drain hole, including:

a stainless steel wire having a first end and a second end, wherein the first end includes a plurality of extensions each positioned to receive the electrical current transmitted through the electrolyte fluid by the primary electrode, and wherein the second end positioned adjacent to the internal surface;

a porous stopper that positions the stainless steel wire within the drain hole, and allows the electrolyte fluid to flow to and from the internal surface; and a voltage booster configured to boost a calibrated voltage from the main DC power supply at the second end;

wherein the auxiliary electrode receives the electrical current from the electrolyte fluid at the first end, and boosts the calibrated voltage from the main DC power supply in proximity to the drain hole at the second end; and wherein the internal surface is in fluid communication with the electrolyte fluid only through the drain hole.

2. The system of claim 1, wherein the auxiliary electrode is configured to boost the calibrated voltage by approximately 20 percent to approximately 50 percent.

3. The system of claim 1, wherein the first end of the auxiliary electrode includes a plurality of extensions configured to attract the electrical current within the electrolyte fluid.

4. The system of claim 1, wherein the auxiliary electrode boosts the calibrated voltage via one of: a battery, an induction device, and an energy harvesting device.

5. The system of claim 4, including the induction device, wherein the induction device includes:

a transmitting (TX) unit configured to transmit an electromagnetic wave through the electrolyte fluid; and a receiving (RX) unit that is wirelessly coupled with the TX unit, wherein the RX unit is configured to:

receive the electromagnetic wave from the TX unit;

convert the electromagnetic wave into a DC voltage; and apply the DC voltage to the auxiliary electrode, thereby providing a voltage jump at the second end.

6. The system of claim 5, wherein the TX unit includes an AC power supply, a TX circuit configured to regulate an AC electrical current from the AC power supply, and a TX antenna which transmits the regulated AC current as the electromagnetic wave.

7. The system of claim 4, including the energy harvesting device, wherein the energy harvesting device includes a piezoelectric device energized via vibration energy from movement of the metallic substrate, and a rechargeable power supply in electrical communication with the piezoelectric device.

8. A method for depositing a thin film material onto an internal surface of a metallic substrate through a drain hole defined by the metallic substrate when the metallic substrate is submersed in an electrolyte fluid during an electrocoating process, the method comprising:

positioning an auxiliary electrode in the drain hole via a porous stopper, wherein the internal surface is in fluid communication with the electrolyte fluid only through the drain hole, and wherein the auxiliary electrode includes:

a stainless steel wire having a first end that includes a plurality of extensions each positioned to receive an electrical current transmitted through the electrolyte fluid by a primary electrode when the primary electrode is energized by a main DC power supply, and a second end; and the porous stopper, which is configured to allows the electrolyte fluid to flow to and from the internal surface; and a voltage booster configured to boost a calibrated voltage from the main DC power supply at the second end;

applying a calibrated voltage from the main DC power supply to the primary electrode to generate an electrical current;

wirelessly transmitting the electrical current through the electrolyte fluid toward the metallic substrate;

receiving the electrical current from the electrolyte fluid at the first end of the auxiliary electrode; and boosting the calibrated voltage in proximity to the drain hole at the second end of the auxiliary electrode.

9. The method of claim 8, further comprising:

wirelessly transmitting an electromagnetic wave through the electrolyte fluid using a transmitting (TX) unit;

receiving the electromagnetic signal via a receiving (RX) unit;

converting the electromagnetic signal into a DC voltage using the RX unit; and boosting the calibrated voltage via the DC voltage.

10. The method of claim 9, wherein the TX unit includes an AC power supply, a TX circuit in electrical communication with the AC power supply, and a TX antenna, the method further comprising:

regulating AC current from the AC power supply using the TX circuit; and transmitting the regulated AC current as an electromagnetic wave through the electrolyte fluid using the TX antenna.

11. The method of claim 8, wherein the auxiliary electrode includes one of a battery, an induction device, and an energy harvesting device, and wherein boosting the calibrated voltage is accomplished via one of the battery, the induction device, and the energy harvesting device.

12. An auxiliary electrode assembly for electrocoating a metallic substrate, wherein the metallic substrate defines a drain hole and a pair of internal surfaces that are in fluid communication with an electrolyte fluid only through the drain hole, the auxiliary electrode assembly comprising:

a stainless steel wire having:

a first end that includes a plurality of extensions each positioned to receive an electrical current transmitted wirelessly through the electrolyte fluid by a primary electrode when the primary electrode is energized by a main DC power supply; and a second end positioned between the pair of internal surfaces;

a porous stopper configured to position the wire within the drain hole, and to allow the electrolyte fluid to flow to and from the internal surfaces; and a voltage booster configured to boost a calibrated voltage from the main DC power supply at the second end.

13. The assembly of claim 12, further comprising an insulating enclosure that insulates at least part of the stainless steel wire, wherein the porous stopper defines a center opening within which the insulating enclosure is press-fitted.

14. The assembly of claim 12, wherein the first end includes three of the extensions.

15. The assembly of claim 12, wherein the voltage booster is one of: a battery, a wireless induction device, and a piezoelectric energy-harvesting device.

16. The assembly of claim 15, including the induction device, and further comprising a controller configured to vary the calibrated voltage as a function of dwell time of the metallic substrate within the electrolyte fluid.

* * * * *